US010751855B2

(12) United States Patent
Liu

(10) Patent No.: US 10,751,855 B2
(45) Date of Patent: Aug. 25, 2020

(54) FIXTURE FOR FIXING STEERING KNUCKLE IN MACHINING PROCESS

(71) Applicant: CITIC Dicastal CO., LTD., Qinhuangdao, Hebei (CN)

(72) Inventor: Xiao Liu, Qinhuangdao (CN)

(73) Assignee: CITIC Dicastal CO., LTD., Qinhuangdao (CN)

( * ) Notice: Subject to any disclaimer, the term of this patent is extended or adjusted under 35 U.S.C. 154(b) by 102 days.

(21) Appl. No.: 16/113,042

(22) Filed: Aug. 27, 2018

(65) Prior Publication Data

US 2019/0076992 A1 Mar. 14, 2019

(30) Foreign Application Priority Data

Sep. 13, 2017 (CN) ..... 2017 1 0822693

(51) Int. Cl.

| | |
|---|---|
| ***B25B 5/12*** | (2006.01) |
| ***B25B 5/14*** | (2006.01) |
| ***B25B 5/16*** | (2006.01) |
| ***B25B 5/02*** | (2006.01) |
| ***B25B 5/00*** | (2006.01) |
| ***B25B 5/06*** | (2006.01) |

(52) U.S. Cl.

CPC ..... *B25B 5/14* (2013.01); *B25B 5/003* (2013.01); *B25B 5/006* (2013.01); *B25B 5/02* (2013.01); *B25B 5/064* (2013.01); *B25B 5/163* (2013.01)

(58) Field of Classification Search

CPC .... B25B 1/00; B25B 1/14; B25B 3/00; B25B 5/00; B25B 5/12

See application file for complete search history.

(56) References Cited

U.S. PATENT DOCUMENTS

| | | | | |
|---|---|---|---|---|
| 4,867,427 A * | 9/1989 | Cunningham | ..... | B25B 5/003 269/88 |
| 5,435,533 A * | 7/1995 | Weinmann, Jr. | ..... | B25B 5/12 269/228 |
| 6,264,186 B1 * | 7/2001 | Hill | ..... | B23Q 1/032 269/289 R |
| 6,375,177 B1 * | 4/2002 | Witte | ..... | B23Q 3/103 269/289 R |
| 8,393,605 B2 * | 3/2013 | Yang | ..... | B25B 5/003 269/287 |
| 8,985,564 B2 * | 3/2015 | Stanifer | ..... | B23Q 3/069 269/281 |

(Continued)

FOREIGN PATENT DOCUMENTS

| | | |
|---|---|---|
| CN | 201997968 U | 10/2011 |
| CN | 202344284 U | 7/2012 |

(Continued)

*Primary Examiner* — Lee D Wilson

(74) *Attorney, Agent, or Firm* — Cooper Legal Group, LLC

(57) ABSTRACT

The present disclosure provides a fixture for fixing a steering knuckle in a machining process, the fixture comprises a bottom plate, wherein the bottom plate is machined with two bottom plate windows that are configured to accommodate machined parts of the steering knuckle; three groups of pressure claws and three groups of locating pins are fixed on the bottom plate, and the pressure claws and the locating pins are respectively fixed to the through holes of the bottom plate; and the three groups of pressure claws are respectively arranged at three vertexes of a triangle.

1 Claim, 6 Drawing Sheets

(56) References Cited

U.S. PATENT DOCUMENTS

| | | | | |
|---|---|---|---|---|
| 10,232,481 | B2 * | 3/2019 | Habel | B23Q 1/035 |
| 2011/0266733 | A1 | 11/2011 | Nix | |
| 2015/0231749 | A1 | 8/2015 | Miller et al. | |
| 2019/0076992 | A1 * | 3/2019 | Liu | B25B 5/14 |
| 2019/0224794 | A1 * | 7/2019 | Luthi | F15B 11/20 |
| 2019/0321924 | A1 * | 10/2019 | Lin | B25B 5/006 |

FOREIGN PATENT DOCUMENTS

| | | | |
|---|---|---|---|
| CN | 203936658 | U | 11/2014 |
| CN | 204621574 | U | 9/2015 |
| CN | 205363365 | U | 7/2016 |
| CN | 105945616 | A | 9/2016 |
| CN | 205817393 | U | 12/2016 |
| CN | 106695400 | A | 5/2017 |
| CN | 207464702 | U | 6/2018 |
| DE | 202017101179 | U1 | 5/2017 |

* cited by examiner

FIXTURE FOR FIXING STEERING KNUCKLE IN MACHINING PROCESS

CROSS-REFERENCE TO RELATED APPLICATIONS

The present application claims benefit of Chinese Patent Application No. 201710822693.6, filed on Sep. 13, 2017, the contents of which are hereby incorporated by reference in its entirety.

BACKGROUND

The steering knuckle is a key part for connecting an automobile steering system and a suspension system. The steering knuckle is connected with an automobile suspension, a front axle, a steering system and a brake assembly, and can bear the front load of an automobile, and supporting and driving a front wheel to rotate along a master pin so as to realize flexible steering of the automobile, ensure stable running of the automobile and sensitively transfer the driving direction. In the driving state of the automobile, it bears complex and changeable load, and is thus required to have high strength and rigidity and reliable safety factor. The steering knuckle is complex in structure and needs to be machined with many holes and planes, so its machining precision directly affects the assembly precision, safety and reliability in practical use.

At present, machining of all planes, holes and threads of the steering knuckle is usually completed by at least three procedures, and the change of a fixture will arouse the problem of resetting, as a result, the tolerance of the relevant part is overproof and the precision is unlikely to guarantee. The auxiliary time between the procedures is long, so the overall time is increased, the efficiency is low and the labor intensity of workers is high. Therefore, if a fixture that can complete all the machining of the steering knuckle on one machine tool and one procedure can be designed, the above problems occurring in production can be well solved, and the product quality can be guaranteed.

SUMMARY

The present disclosure relates to a fixture, specifically to a fixture for fixing a steering knuckle in a machining process.

Thus, the objective of the present disclosure is to provide a fixture, which can meet the requirement for completing all machining of a steering knuckle on one machine tool.

In order to achieve the above objective, the present disclosure provides a steering knuckle machining fixture.

In one aspect of the present disclosure, provided is a fixture for fixing a steering knuckle in the machining process. The fixture includes a bottom plate, and the bottom plate is machined with two bottom plate windows that are configured to accommodate machined parts of the steering knuckle; three groups of pressure claws and three groups of locating pins are fixed on the bottom plate, and the pressure claws and the locating pins are respectively fixed to the through holes of the bottom plate; and the three groups of pressure claws are respectively arranged at three vertexes of a triangle.

In an embodiment of the present disclosure, the fixture is composed of the bottom plate, a locating pin Z1, a pressure claw Z1, a floating locating pin ZXY, an eccentric column, a locating pin Z2, a pressure claw Z2, a card slot Z2, a pressure claw Z3, a locating block, a locating pin Z3, a floating locating pin ZR, a pressure claw substrate Z2, a bottom plate window I, a bottom plate window II, a pressure claw substrate Z1, a locating pin base ZXY, a pressure claw substrate Z3 and a locating pin base ZR; the fixture is characterized in that the bottom plate is machined with the bottom plate window I and the bottom plate window II that are configured to accommodate a machined area of the steering knuckle; the locating pin Z1, the locating pin Z2 and the locating pin Z3 are assembled on the through holes of the bottom plate by interference assembly; the pressure claw substrate Z2, the pressure claw substrate Z1, the locating pin base ZXY, the pressure claw substrate Z3 and the locating pin base ZR are connected with the bottom plate by bolts, and a spring is assembled below the locating pin base ZXY and the locating pin base ZR; the pressure claw Z1, the pressure claw Z2 and the pressure claw Z3 are respectively connected with the pressure claw substrate Z21, the pressure claw substrate Z2 and the pressure claw substrate Z3 through rotating shafts; the eccentric column is in interference fit with the bottom plate; two through holes in the locating block are strip-shaped, the locating block is mounted on the bottom plate through two bolts, and the locating block is configured to move in a long axis direction of the strip-shaped through holes.

In an embodiment of the present disclosure, the locating block includes two strip-shaped through holes, and is mounted on the bottom plate through two bolts, and configured to move in the long axis direction of the strip-shaped through holes.

In an embodiment of the present disclosure, locating Z1, locating Z2, locating Z3, locating XY and locating R are designed according to the principle of six-point locating, in which Z1, Z2 and Z3 correspond to three small platforms on the steering knuckle and limit three degrees of freedom of a workpiece that moves in a Z direction, rotates about an X axis and rotates about a Y axis; the locating XY is a floating round pin, corresponds to a round groove in the steering knuckle, and limits two degrees of freedom of moving in X and Y directions; the locating R is a floating round pin, corresponds to a strip-shaped groove in the steering knuckle, and limits the rotation of the steering knuckle about a Z axis. In this way, the fixture limits the six degrees of freedom of the steering knuckle, thereby stably locating the steering knuckle in a machine tool.

The axial supporting force of the springs ensures that the floating locating pin ZXY and the floating locating pin ZR maintain certain supporting force while having the floating capability. The eccentric column in clearance fit with the bottom plate can rotate continuously and freely, assists in aligning the position of the steering knuckle in the fixture, and has certain error proofing capability. FIG. 4 shows a design schematic diagram of the eccentric column. The locating block moves in the long axis direction of the strip-shaped through holes, assists in aligning the position of the steering knuckle in the fixture, and has certain error proofing capability.

In actual use, the steering knuckle is placed on the fixture by a worker or a robot, the eccentric column and the locating block assist in aligning the position of the steering knuckle in the fixture, the locating pin Z1, the locating pin Z2, the locating pin Z3, the floating locating pin ZXY and the floating locating pin ZR are aligned with the corresponding positions of the steering knuckle, then the pressure claw Z1, the pressure claw Z2 and the pressure claw Z3 compress the steering knuckle, and locating and compression are finally realized, as shown in FIG. 5.

The technical solution of the present disclosure has the main outstanding advantages: all machined parts of the steering knuckle can be completed on one machine tool, so that the demand on machine tools is reduced, the labor cost is reduced, the labor intensity of workers is relieved, the auxiliary time is reduced, the working efficiency is improved, and the yield returns are improved.

BRIEF DESCRIPTION OF DRAWINGS

The embodiments of the present disclosure will be described in detail below in combination with the accompanying drawings, in which:

FIG. 4A and FIG. 4B are schematic diagrams of an eccentric column of the steering knuckle machining fixture according to the present disclosure, in which FIG. 4A is a side view, and FIG. 4B is a top view;

LIST OF REFERENCE SYMBOLS

Figure 1:
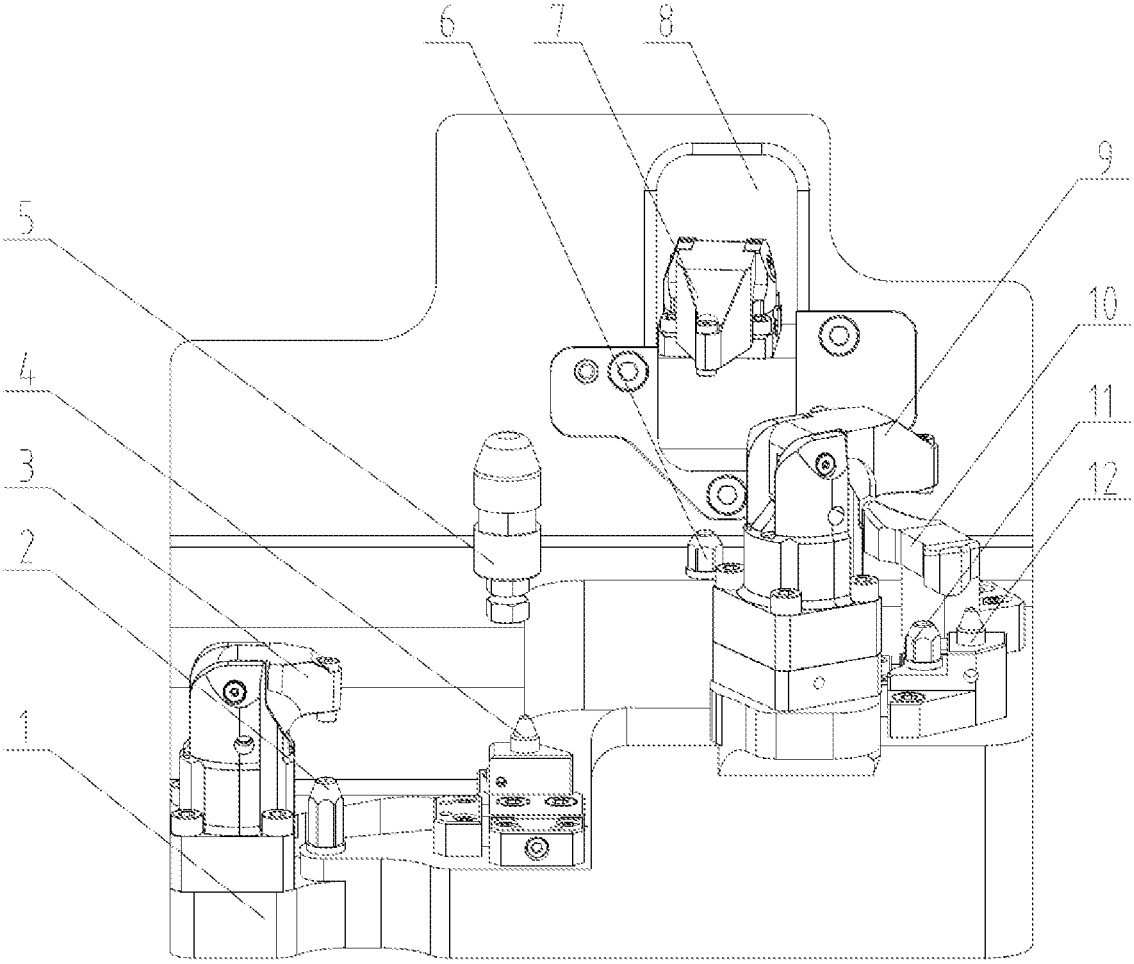
FIG. 1 is a front view of a steering knuckle machining fixture according to the present disclosure.
Figure 2:
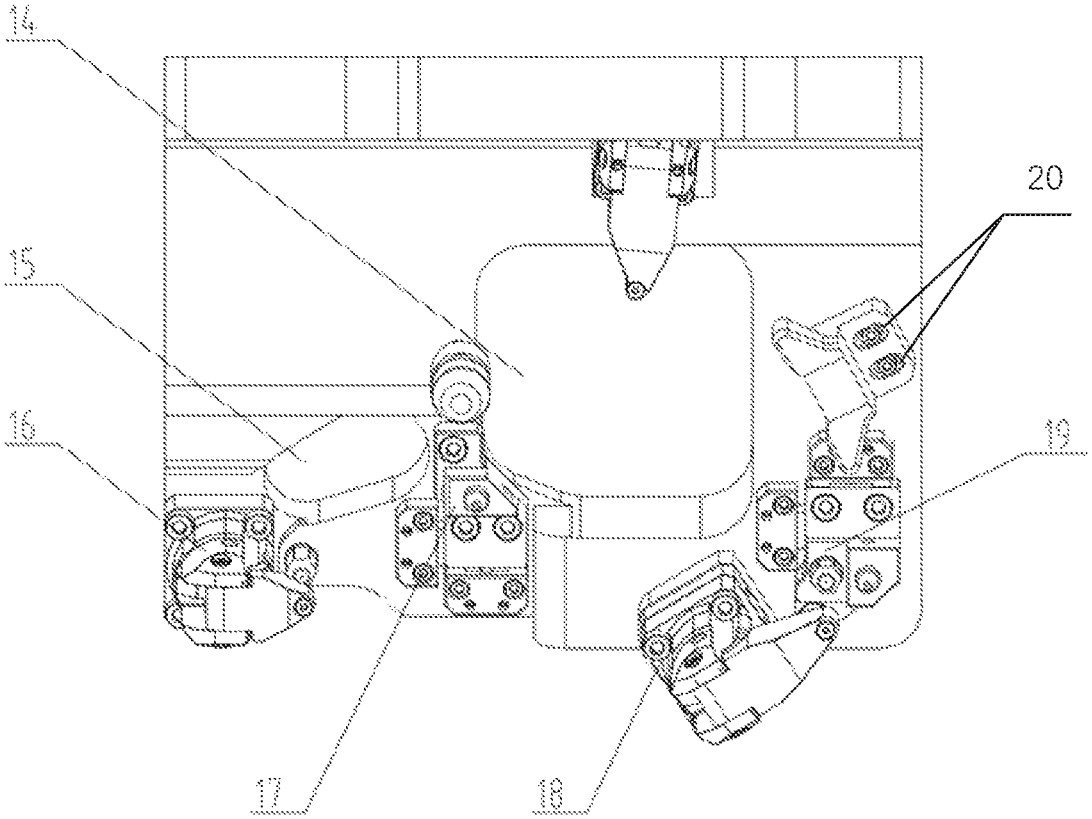
FIG. 2 is a top view of the steering knuckle machining fixture according to the present disclosure.
Figure 3:
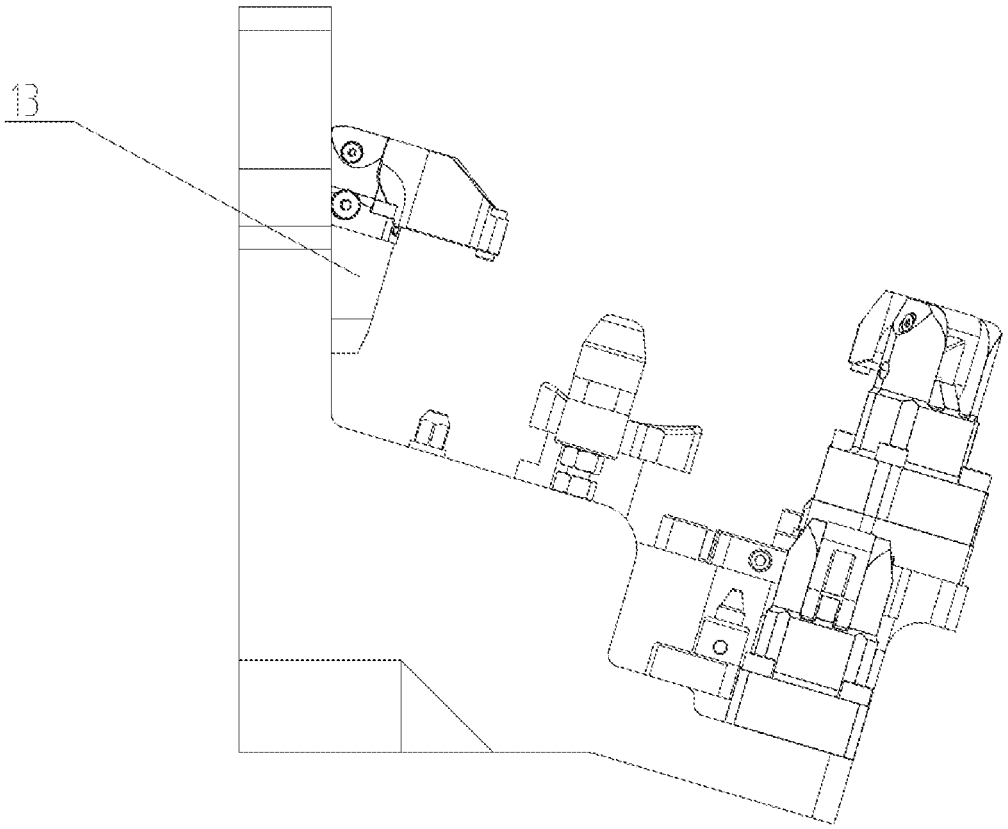
FIG. 3 is a left view of the steering knuckle machining fixture according to the present disclosure.
Figure 4A:
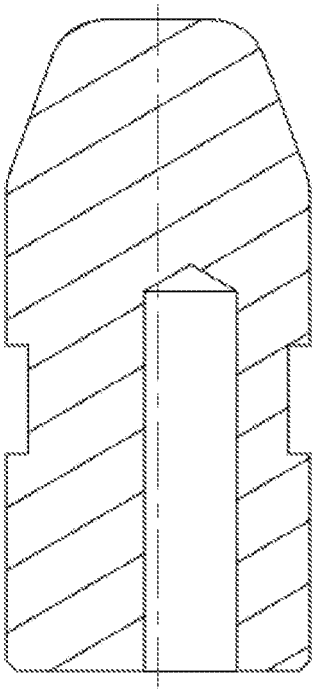
Figure 4B:
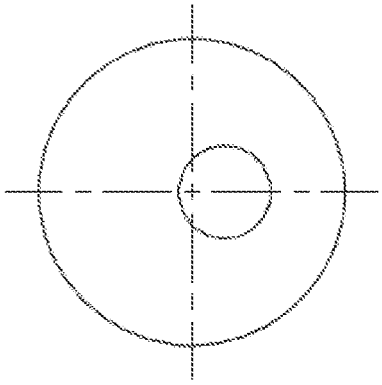
Figure 5:
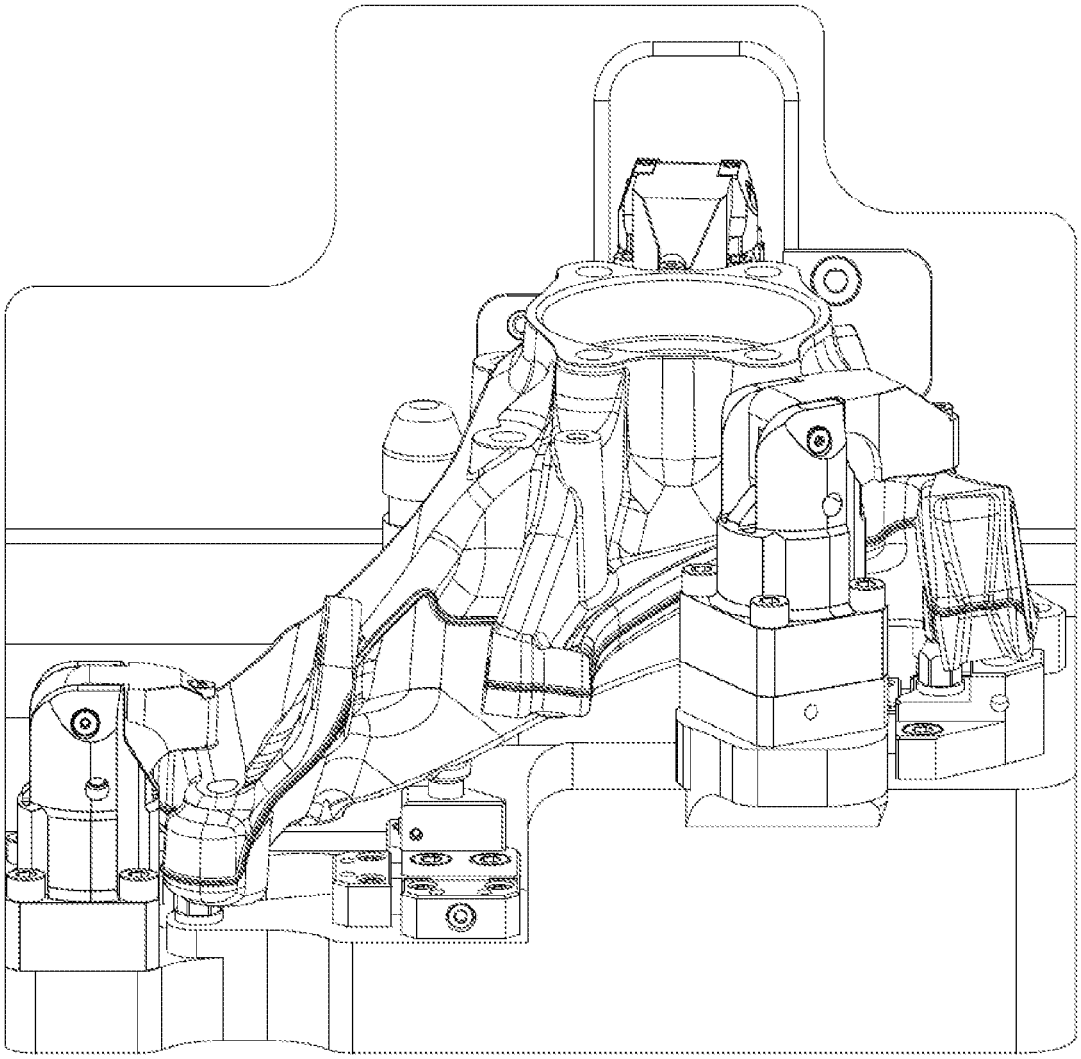
FIG. 5 is a front view showing that the steering knuckle machining fixture according to the present disclosure clamps a workpiece.

1—bottom plate, 2—fixing plate, 3—bolt, 4—motor, 5—eccentric column, 6—locating pin Z2, 7—pressure claw Z2, 8—card slot Z2, 9—pressure claw Z3, 10—locating block, 11—locating pin Z3, 12—floating locating pin ZR, 13—pressure claw substrate Z2, 14—bottom plate window I, 15—bottom plate window II, 16—pressure claw substrate Z1, 17—locating pin base ZXY, 18—pressure claw substrate Z3, 19—locating pin base ZR, 20—strip-shaped through hole.

DETAILED DESCRIPTION

First Embodiment

The specific embodiments of the present disclosure will be further described in detail below in combination with the accompanying drawings.

In one aspect of the present disclosure, provided is a steering knuckle machining fixture. The fixture is characterized by being composed of a bottom plate (1), a locating pin Z1 (2), a pressure claw Z1 (3), a floating locating pin ZXY (4), an eccentric column (5), a locating pin Z2 (6), a pressure claw Z2 (7), a card slot Z2 (8), a pressure claw Z3 (9), a locating block (10), a locating pin Z3 (11), a floating locating pin ZR (12), a pressure claw substrate Z2 (13), a bottom plate window I (14), a bottom plate window II (15), a pressure claw substrate Z1 (16), a locating pin base ZXY (17), a pressure claw substrate Z3 (18) and a locating pin base ZR (19). The bottom plate (1) is machined with special-shaped through holes, which include the bottom plate window I (14) and the bottom plate window II (15) and can completely accommodate an area to be machined; the angle between two directions of the bottom plate (1) is 60-120°, preferably 105°; the locating pin Z1 (2), the locating pin Z2 (6) and the locating pin Z3 (11) are assembled with the through holes in the bottom plate in interference fit; the pressure claw substrate Z2 (13), the pressure claw substrate Z1 (16), the locating pin base ZXY (17), the pressure claw substrate Z3 (18) and the locating pin base ZR (19) are connected with the bottom plate (1) by bolts, a spring is assembled below the locating pin base ZXY (17) and the locating pin base ZR (19), and the axial supporting force of the springs ensures that the floating locating pin ZXY (4) and the floating locating pin ZR (12) maintain certain supporting force while having the floating capability; the pressure claw Z1 (3), the pressure claw Z2 (7) and the pressure claw Z3 (9) are connected with the pressure claw substrate Z21 (16), the pressure claw substrate Z2 (13) and the pressure claw substrate Z3 (18) through rotating shafts; the eccentric column (5) in clearance fit with the bottom plate (1) can rotate continuously and freely; two through holes (20) in the locating block (10) are strip-shaped, the locating block (10) is mounted on the bottom plate (1) through two bolts, and the locating block (10) can move in a long axis direction of the strip-shaped through holes (20), assists in aligning the position of a steering knuckle in the fixture, and has certain error proofing capability. According to the technical solution of the present disclosure, all machined parts of the steering knuckle can be completed on one machine tool, so that the demand on machine tools is reduced, the labor cost is reduced, the labor intensity of workers is relieved, the auxiliary time is reduced, the working efficiency is improved, and the yield returns are improved.

Second Embodiment

The following cutter scheme can be adopted based on the first embodiment. Totally 15 cutters are used for machining the steering knuckle. 1) a clamp mounting plane, a threaded hole end face and a central hole are roughly machined using a D25 mm diamond end milling cutter; 2) a sensor mounting plane and a flange mounting plane are machined using a D63 plane milling cutter; 3) a sensor mounting hole is machined using a chamfered hard alloy cutter D10; 4) a sensor mounting threaded hole bottom hole is machined using a chamfered hard alloy cutter D5.55; 5) a flange plane mounting threaded hole bottom hole is machined using a chamfered hard alloy step drill D5.55/D7.15; 6) threads are tapped using an M6 screw tap; 7) through holes are machined using a chamfered hard alloy drill D12; 8) a flange plane mounting bolt through hole is machined using a diamond drill D25; 9) an M14 threaded bottom hole is machined using a chamfered hard alloy step drill; 10) threads are tapped using an M14 screw tap; 11) a large arc surface is milled using a D16 ball mill; 12) an M12 threaded bottom hole is machined using a chamfered hard alloy drill D11.3; 13) threads are tapped using an M11 screw tap; 14) the central hole is precisely machined using a diamond step drill; and 15) the through holes are precisely machined using a diamond boring cutter D42.

The objective of completing all machined parts of the steering knuckle by single clamping is achieved by adopting the above cutter scheme.

The invention claimed is:

1. A fixture for fixing a steering knuckle in a machining process, comprising a bottom plate, wherein the bottom plate is machined with two bottom plate windows that are configured to accommodate machined parts of the steering knuckle; three groups of pressure claws and three groups of locating pins are fixed on the bottom plate, and the three groups of pressure claws and the three groups of locating pins are respectively fixed to through holes of the bottom plate; and the three groups of pressure claws are respectively arranged at three vertexes of a triangle, the fixture comprises a first locating pin of the three groups of locating pins, a first pressure claw of the three groups of pressure claws, a first floating locating pin, an eccentric column, a second locating pin of the three groups of locating pins, a second pressure claw of the three groups of pressure claws, a first card slot, a third pressure claw of the three groups of pressure claws, a locating block, a third locating pin of the three groups of locating pins, a second floating locating pin, a first pressure claw substrate, a first bottom plate window of the two bottom plate windows, a second bottom plate window of the two bottom plate windows, a second pressure claw substrate, a first locating pin base, a third pressure claw substrate and a second locating pin base; the fixture is characterized in that the bottom plate is machined with the first bottom plate window and the second bottom plate window that are configured to accommodate a machined area of the steering knuckle; the first locating pin, the second locating pin and the third locating pin are assembled to the through holes of the bottom plate by an interference assembly; the first pressure claw substrate, the second pressure claw substrate, the first locating pin base, the third pressure claw substrate and the second locating pin base are connected with the bottom plate by bolts, and a spring is assembled below the first locating pin base and the second locating pin base; the first pressure claw, the second pressure claw and the third pressure claw are respectively connected with the first pressure claw substrate, the second pressure claw substrate and the third pressure claw substrate through rotating shafts; the eccentric column is in interference fit with the bottom plate; two through holes in the locating block are strip-shaped, the locating block is mounted on the bottom plate through two bolts, and the locating block is configured to move in a long axis direction of the strip-shaped through holes.

* * * * *